US006511391B2

(12) United States Patent
Schroeder

(10) Patent No.: US 6,511,391 B2
(45) Date of Patent: Jan. 28, 2003

(54) OVERHEAD SPORTS ASSEMBLY

(75) Inventor: Edward A. Schroeder, Marengo, IL (US)

(73) Assignee: Porter Athletic Equipment Company, Broadview, IL (US)

( * ) Notice: Subject to any disclaimer, the term of this patent is extended or adjusted under 35 U.S.C. 154(b) by 65 days.

(21) Appl. No.: 09/826,039

(22) Filed: Apr. 5, 2001

(65) Prior Publication Data

US 2002/0147063 A1 Oct. 10, 2002

(51) Int. Cl.[7] ..... A63B 63/08
(52) U.S. Cl. ..... 473/482
(58) Field of Search ..... 473/482, 479; 403/87, 99, 142, 205, 410, 103; 602/16

(56) References Cited

U.S. PATENT DOCUMENTS

| | | | | |
|---|---|---|---|---|
| 1,778,173 A | | 10/1930 | Steele | |
| 1,919,494 A | * | 7/1933 | Albach | 473/482 |
| 2,961,236 A | | 11/1960 | Murphy | |
| 3,598,407 A | * | 8/1971 | Sorensen | 473/482 |
| 4,323,059 A | * | 4/1982 | Rambert et al. | 602/16 |
| 4,437,480 A | * | 3/1984 | Husa | 135/74 |
| 4,710,049 A | * | 12/1987 | Chang | 403/23 |
| 5,038,765 A | * | 8/1991 | Young et al. | 602/16 |
| 5,639,174 A | * | 6/1997 | Gonska | 403/103 |

OTHER PUBLICATIONS

AALCO Catalog (1998) pp. 1–16.
Jaypro Sports Equipment Catalog (1997) pp. 1–19.
Jaypro Sports Equipment Brochure (1997), eight unnumbered pages.
Draper Catalog, pp. 1–23.
Court Source Sports Equipment Catalog (1996) pp. 22–25.

* cited by examiner

*Primary Examiner*—Paul T. Sewell
*Assistant Examiner*—M. Chambers
(74) *Attorney, Agent, or Firm*—Barnes & Thornburg

(57) ABSTRACT

An overhead sport assembly includes a mast pivotally coupled to an overhead structure near a first end of the mast, and a sport apparatus, such as a basketball goal or volleyball net, for example, coupled near a second end of the mast. A pair of braces hold the masts in the play position. The braces include a first brace with a first end pivotally coupled to an overhead structure at a pivot point displaced from the first end of the mast, and a second brace with a first end pivotally connected to the mast at a pivot point displaced from the first end of the mast. The second ends of the braces are pivotally coupled to a connector at respective pivot points displaced from one another along the connector. The braces and the connector being cooperatively configured to allow the braces to pivot from the stowed position to the play position, and further configured to prevent further rotation past the play position.

37 Claims, 7 Drawing Sheets

OVERHEAD SPORTS ASSEMBLY

BACKGROUND OF THE INVENTION

Overhead mounted sports equipment is well-known. For example, basketball goals may be suspended from overhead structures and pivoted between a play position and an overhead stowed position. The development of brackets and connectors used to suspend the equipment, however, continues to progress and improve.

Typically, a sporting apparatus, such as a basketball goal, was held in the play position by a pair of pivotally linked braces. In this typical arrangement, one brace was pivotally coupled to an overhead structure, and the other brace was pivotally connected to a mast which supported the apparatus. The braces were pivotally linked to one another at a single pivot point.

A linking mechanism was developed in order to lock out the braces when the goal was in the play position. The linking mechanism of the prior art coupled the pair of braces together in such a way as to "lock" the sporting apparatus into a play position. Additionally, the prior art provided a means for allowing the braces to rotate relative to one another until the braces reached the play position; however, when the braces reached the play position, they locked and were prevented from further rotation. This created a relatively stable goal for many purposes.

However, the typical locking linking mechanism of the prior art had a pivot point that was generally slightly offset from the longitudinal axes of the braces. Therefore, a strong compressive force in the braces—such as the force of a slam-dunk or one hanging on the rim—created a natural moment about the pivot point. This induced moment caused the braces to unlock.

Once the braces came unlocked, the braces had to be locked in order to make the apparatus stable once again. In order to address this problem, the prior art developed further. Specifically, the sport apparatus could be pivotally coupled at its mast in an off-center arrangement in order to create a natural moment—a moment caused by the weight of the mast—that tended to rotate the mast away from the braces and induce tensile forces in the braces. Therefore, if the braces became unlocked, the moment could act to pull the prior-art linking mechanism back to its locked position.

Notwithstanding the improved off-center mounting arrangement, the relocking of the braces often could not occur on its own, without manual assistance or urging; sometimes, the natural moment due to the off-center mounting of the mast did not induce enough pull to re-lock the braces.

In addition to the above-referenced problem in the prior art, other shortcomings existed. The prior art link coupled the pair of braces directly to one another. Therefore, there was a pre-set pattern for each of the links to follow as the apparatus was moved between the play and stowed positions. The placement of each of the pivot points was critical. Minor errors in placement of these points could cause the overhead sports assembly of the prior art to not fold or stow properly. The requirement for precision placement of the pivot points, ofcourse, required increased installation costs.

Additionally, the braces and mast will deform and creep over time. Joints may erode, braces may slightly expand, or welds may stretch. etc. Thus, a system that was properly installed and working smoothly initially may cease to fold properly.

The current invention addresses many of the shortcomings of the prior art. The invention provides a link between braces of an overhead sporting apparatus that will provide a sturdy support, and will also accommodate minor errors in installation and changes in the materials by allowing for a slight degree of 'play' that was not present in the prior art arrangement.

SUMMARY OF THE INVENTION

The invention relates to an overhead sport assembly, such as a basketball goal or volleyball net, movable between a play position to a stowed position. The assembly includes a mast pivotally coupled to an overhead structure near a first end of the mast. A pair of braces hold the masts in the play position. A first brace is pivotally coupled near its first end to an overhead structure at a pivot point displaced from the first end of the mast. A second brace is pivotally connected near its first end to the mast at a pivot point displaced from the first end of the mast.

A connector links the second ends of the braces. The second ends of the braces are pivotally coupled to the connector body at respective pivot points displaced from one another along the connector. Preferably, the pivot points are substantially aligned when the apparatus is in the play position.

Typically, the overhead sports apparatus may be incorporated into an overhead basketball goal support; however, the apparatus may have other applications, such supports for nets for volleyball, badminton, or tennis, for example.

In the event one uses the invention as a basketball support apparatus, the invention will include a backboard with a front face. Generally, the backboard is mounted adjacent a second end of the mast. The braces of the assembly may be mounted to extend either behind or in front of the backboard.

The braces and the connector may be cooperatively formed so that, when in the play position, the first brace is allowed to rotate about with respect to the connector body only in a first direction of rotation, and the second brace is allowed to rotate with respect to the connector body opposite the first direction.

A yoke having aligned holes may extend from respective second ends of each of the first and second braces. In order to pivotally connect the braces to the connector, a pin extends through respectively aligned holes in the connector and yokes, each pin thereby defining a pivot point. Alternatively, the position of the yokes may be reversed; the yokes may extend from opposite ends of the connector.

In another embodiment, the connector includes a pair of spaced-apart plates, each plate having a pair of spaced-apart holes. In this embodiment, the second ends of each of the first and second braces terminate in a web having a hole. The braces are pivotally coupled to the connector by inserting a pin through the respectively aligned holes to define respective pivot points. In this embodiment, at least one torsion spring may be positioned between the spaced apart plates in order to bias the braces toward the play position.

The assembly will also include a stop configured to prevent the braces from extending past the play position. The stop includes a first portion on the connector extending from the connector parallel to its longitudinal axis, and a second portion on the connector substantially perpendicular its longitudinal axis. The stop further includes a raised area on the second end of each brace, each raised area having a first portion substantially parallel to a longitudinal axis of the respective brace. The raised area also has a second portion substantially perpendicular to the longitudinal axis of the brace. Each of the connector and raised areas include respective intermediate portions connecting the first and section sections. The first, second and intermediate portions are all cooperatively configured to respectively engage one another when the assembly is in the play position.

The raised area further comprises an angled portion extending from the second section and disposed at an acute angle with respect to the longitudinal axis of the brace in a direction away from the connector. The angled portion provides a clearance as the connector rotates with respect to the brace. The connector may have chamfered ends configured to allow clearance as the assembly is moved toward the stowed position.

Typically, the connector further includes an intermediate, curved portion connecting the first and section portions of the connector. The raised area also further includes an intermediate portion connecting the first and second portions of the raised area. Thus, the respective intermediate portions of the raised area and the connector will engage one another when in the play position.

The apparatus may also have an off-center coupling arrangement coupling the mast to the overhead structure. In order to accomplish this off-center coupling, the mast is coupled to the overhead structure at a location displaced from the longitudinal axis of the mast, thereby creating a rotating moment configured to create tensile force in the braces when the assembly is in the play position.

A torsion spring may be provided between the connector and the second end of the braces.

The apparatus may also include a cable and pulley arrangement configured to allow an operator to selectively move the mast between the stowed and play positions. A rod may extend from one of the first brace, second brace, or connector. As the cable is pulled in order to pivot the mast toward the stowed position, the cable moves the rod and causes the braces to break from the play position toward the stowed position.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
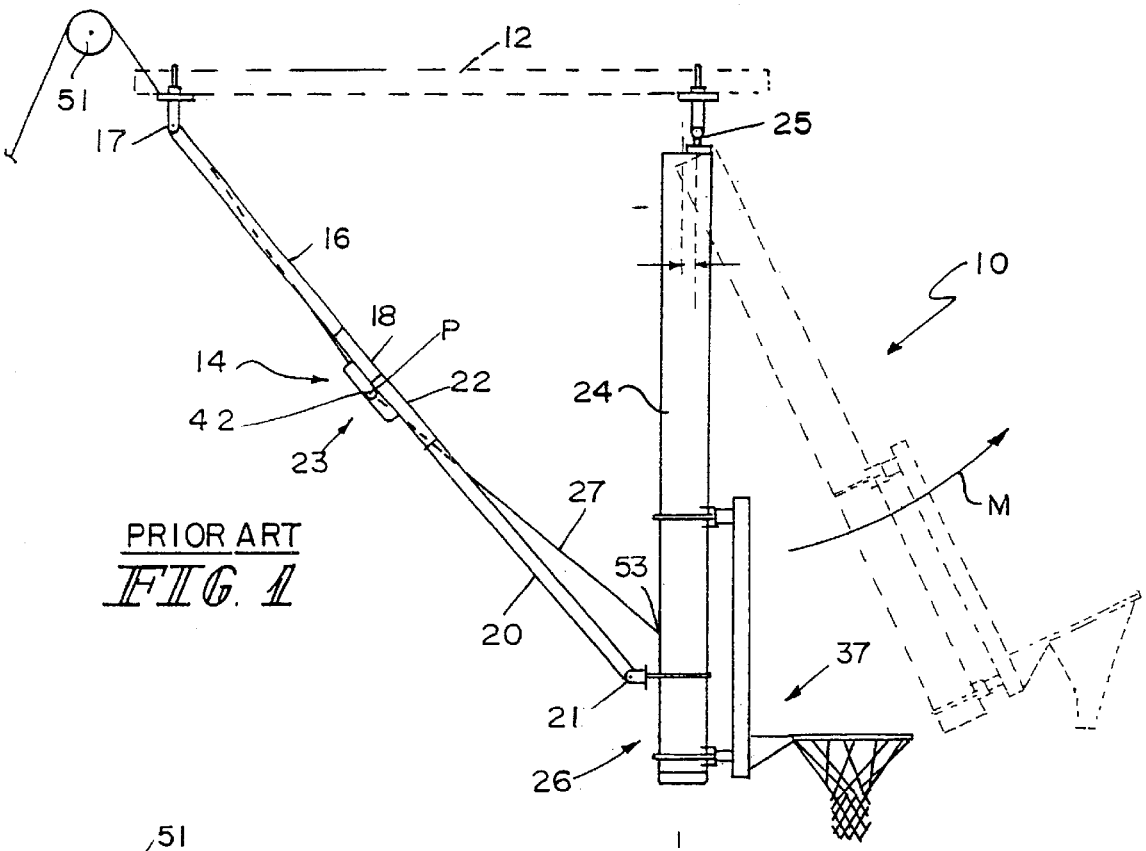
PRIOR ART FIG. 1
FIG. 1 is a side view of an overhead apparatus of the prior art.

FIG. 1 depicts an overhead assembly 10 of the prior art. A basketball backboard and rim apparatus 31 is connected adjacent the lower end 26 of a mast 24 that is pivotally coupled to an overhead structure 12 at its top end 25. The mast 24 has a central axis 29 (shown in FIG. 2). The mast 24 is coupled at a location 25 displaced from its central axis 29, thereby creating a natural moment M tending to rotate the mast 24 and backboard and goal assembly 31 past the vertical plane. The apparatus 10 of the prior art, as shown in FIG. 1 further comprises the pair of linked braces 14 connecting the mast 24 and the overhead structure 12. The pair of braces 14 comprises a first brace 16 and a second brace 20 held together by the linking apparatus 23. The linking apparatus 23 pivotally couples the end 18 of first brace 16 to the end 22 of second brace 20.

Referring still to FIG. 1, each of the first 16 and second 20 braces have longitudinal axes which are substantially aligned along a longitudinal axis when the mast 24 is in the play position. The link 23 is in two parts; each respective part of the link 23 is welded to the second ends 18, 22 of braces 16 and 20. The link 23 has a pivot P about which the ends 18, 22 rotate. The ends 18,22 abut one another when the braces 14 are in the play position, as shown in FIG. 1, thereby preventing further relative rotation past the play position.

The prior art apparatus shown in FIG. 1 shows a cable 27 and pulley 51 setup allowing one to pivot the mast 24 about pivot point at location 25 in order to selectively move the mast between the play and stowed positions. A rod 42 may be provided on one of the braces or link 16, 20, 23. Preferably, the rod may be coaxial with the pivot point P. The cable 27, pulley 51, and rod 42 are cooperatively configured so that, as the cable 27 is pulled taut—as it is when one desires to raise the mast 24—the cable 27 will straighten and move the rod 42, thereby causing the braces 14 to crack from the play position. When the assembly 10 is in the play position, the rod 42 is slightly displaced from a line defined by the pulley 51 and attachment point 53 on the mast 24. As the cable 27 is pulled tight, the cable straightens, which moves the rod 42 from the locked-in-play position, and urges the braces 14 toward the stowed position.

As shown in FIG. 1, the pivot P is offset from the longitudinal axis of the braces 14. As such, compressive forces in the brace 14 will cause a moment about pivot P. This induced moment may cause the braces 16, 20 to crack, creating an unsteady situation.

A hard slam dunk on the apparatus 37 will create a moment about pivot P that could cause the braces 14 to crack about the pivot P, thereby taking the apparatus 10 out of the play position. Once the braces 14 were "unlocked" from the play position, they often remained unlocked. The moment created by the offset mounting of the mast 24 was insufficient to relock the braces. The alternative was to play a game where the apparatus was unsteady and could move in response to contact. Returning the braces 14 to the locked, play position required labor and time. Of course, this may result in unwanted delays, labor costs, and hassles.

The prior art apparatus as shown in FIG. 1, which has a single pivot P, in the link 23 required precision installation. In the event one of the pivotal couplings 17, 21, 25 was not precisely located, the apparatus 10 would not fold properly to the stowed position. A slight installation error of only a few inches could cause the entire system to improperly fold. Additionally, the creep or natural deformation of the material over time would alter the general configuration of the overhead assembly, thereby creating the possibility that the system 10 would not stow correctly or smoothly.

Figure 2:
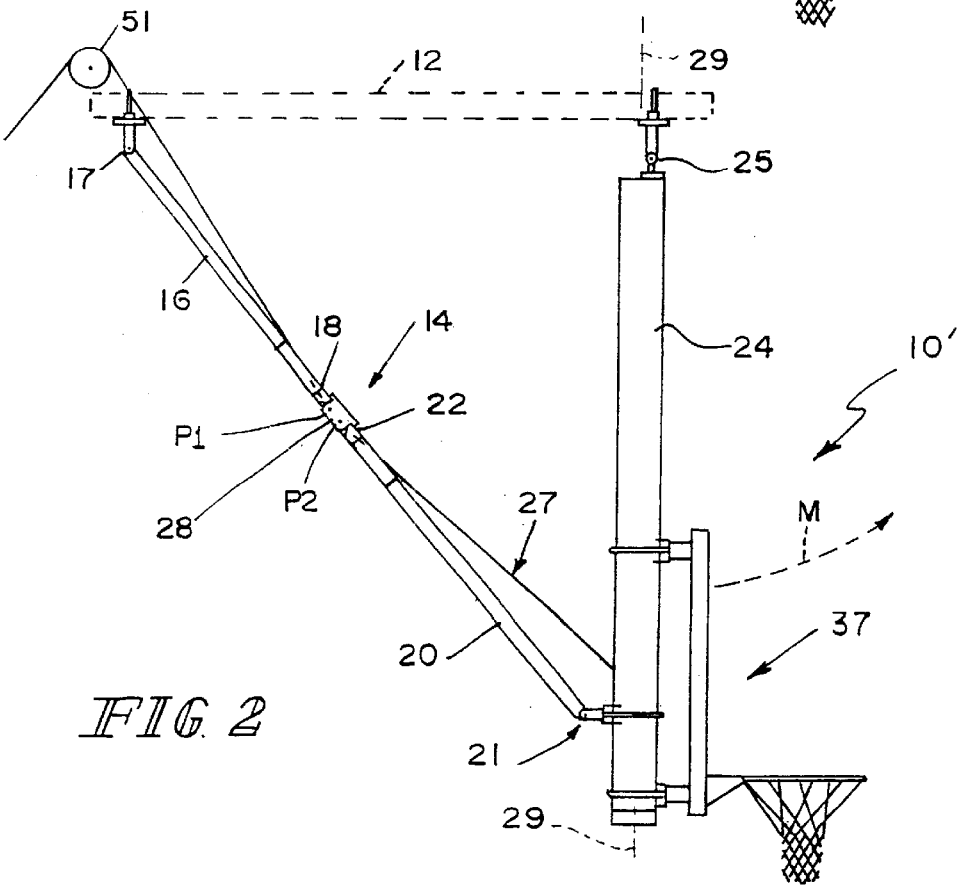
FIG. 2 is a side view of an overhead apparatus, according to the principles of the current invention.

FIG. 2 shows the current invention, which can be used for overhead sports assemblies, such as basketball goals or volleyball nets. The invention shown in FIG. 2 addresses the shortcomings of the prior art by providing a connector that does not link the ends of the braces directly to one another.

Figure 3:
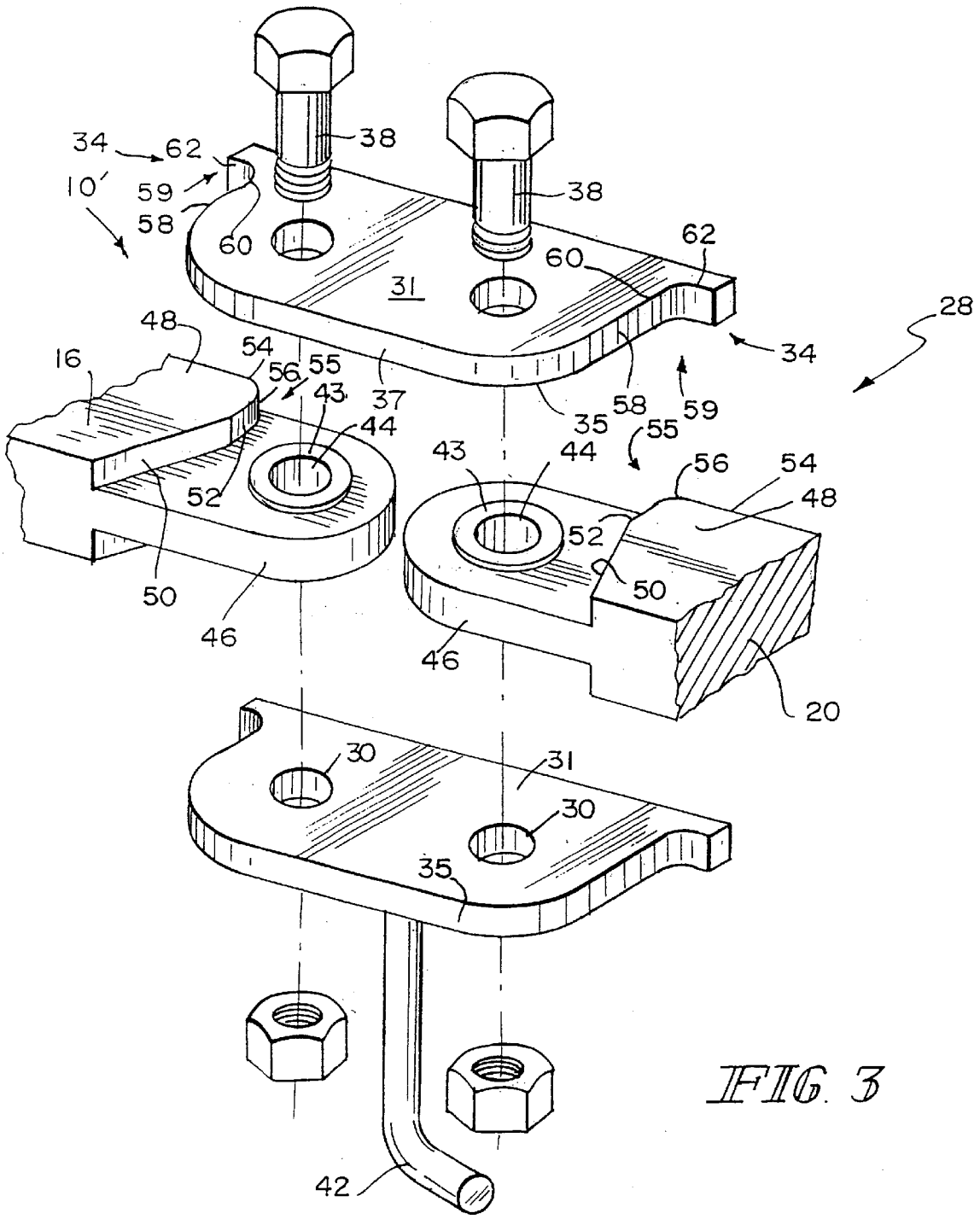
FIG. 3 is an exploded view of one embodiment of the connector, according to the principles of the current invention.
Figure 5:
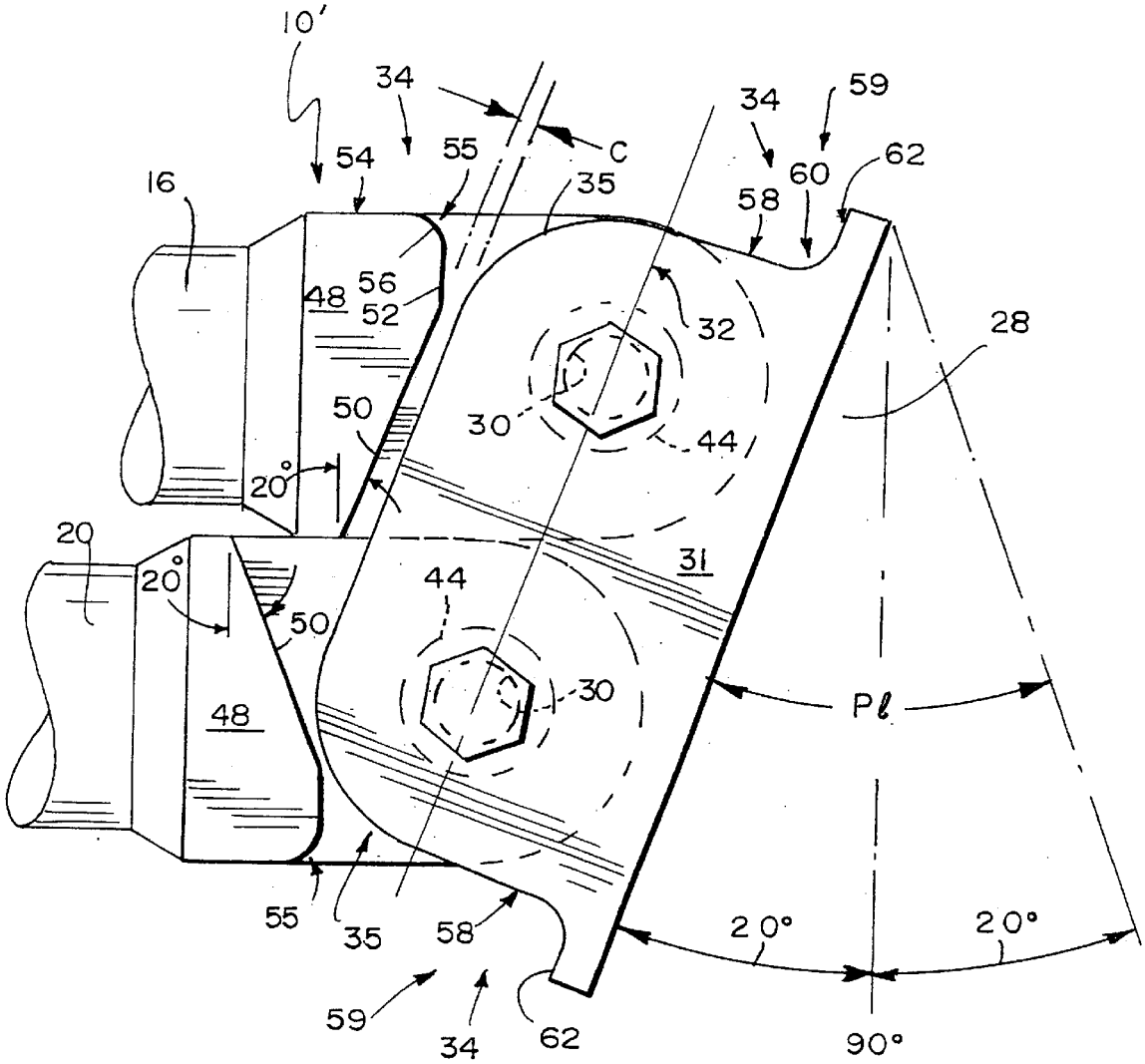
FIG. 5 is a front view of the c braces of the current invention, shown in the stowed position.

FIG. 2 depicts the present invention comprising an overhead apparatus 10' having a mast 24 pivotally coupled adjacent a location 25 to an overhead structure 12. Those elements having the same structure or function as those in the prior art FIG. 1 have the same reference numbers. The mast 24 is coupled to the overhead structure 12 at a location displaced from central axis 29 of the mast 24, thereby inducing a moment M and inducing a tendency to rotate mast 24 in a counter clockwise direction, as shown. The moment M induces tensile forces in braces 14. The braces 14 comprise a first brace 16 pivotally coupled 17 at a first end to the overhead structure 12, and a second brace 20 pivotally connected 21 at a first end to the mast 24. The second end 18 of first brace 16 is linked to the second end 22 of second brace 20 at a connector 28. Connector 28 pivotally receives the second ends 18, 22 of each of the braces 16, 20 at displaced pivot points P1, P2, as shown in FIG. 3. The spaced-apart arrangement of the pivot points P1, P2 allows an arrangement wherein all of the pivot points 17, 21, P1 and P2 are substantially aligned. Additionally, the spaced-apart pivot points P1, P2 allow for some degree of play Pl as shown in FIG. 5, in the positioning of the assembly 10' as it is folded to the stowed position. These features will be discussed in greater detail herein.

Referring again to FIG. 2, the mast 24 supports a basketball backboard and rim apparatus 31 adjacent its second end 26. However, any other equipment, such as a volleyball net, may also be attached adjacent the second end 26 of the mast 24 by using a pair of spaced apart masts 24 in lieu of a single mast. If the assembly 10' is used for volleyball, each mast 24 will include its own braces 14 and connector 28.

As shown in FIG. 2, the invention includes a cable 27 and pulley or winch 51 arrangement is included in order to move the mast 24 between the play and stowed positions. The cable 27 is typically connected to the mast at its end, and operated by a pulley 51 located near the overhead structure 12. As the mast 24 is lowered to the play position, the pair of braces 14 and the connector 28 all align and "lock." Thereupon, the cable 27 may no longer form a straight line, and may even become slack.

Figure 2A:
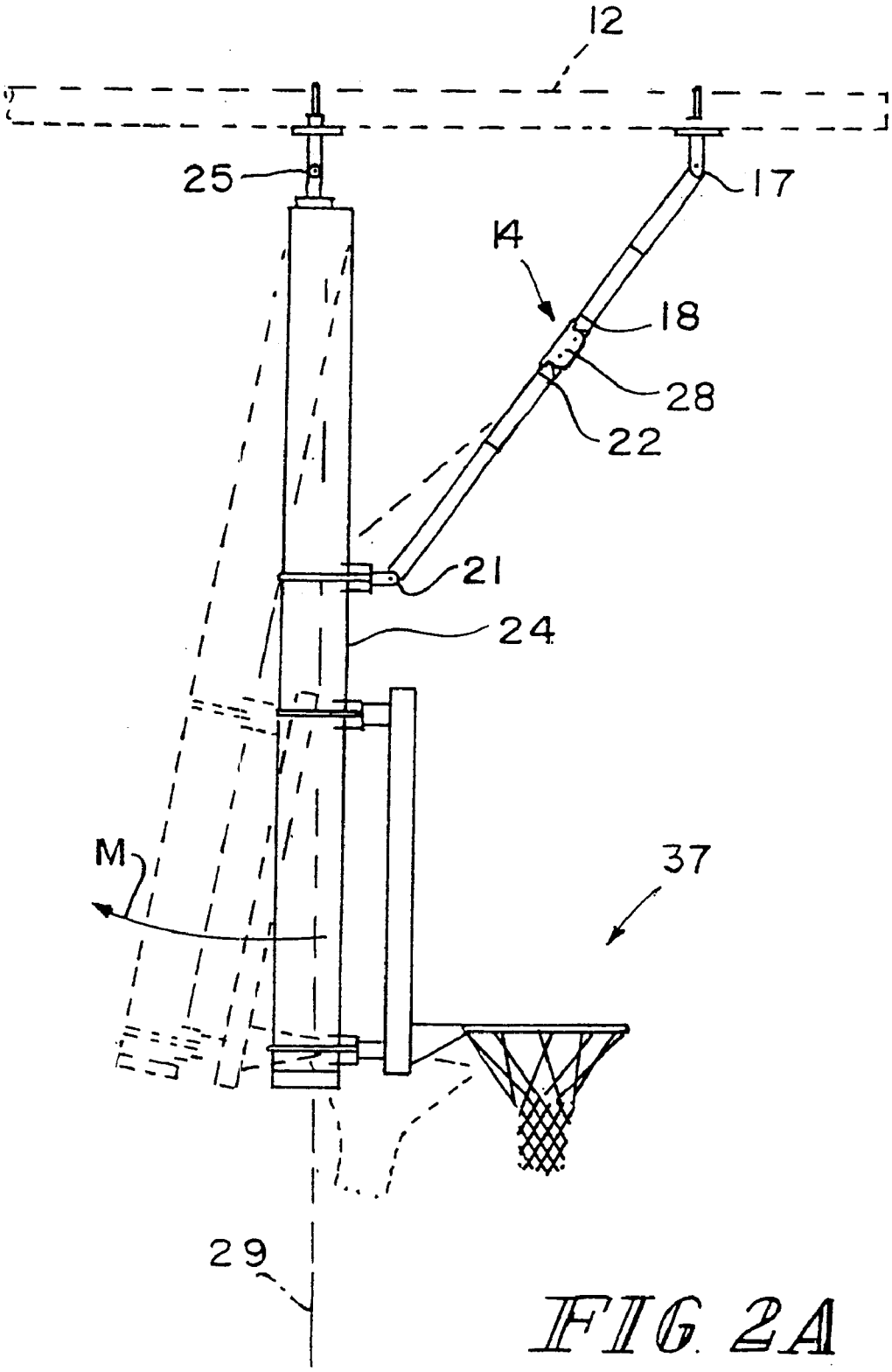
FIG. 2A is a side view of an overhead apparatus, showing a second configuration of the brace assembly according to the principles of the invention.

FIG. 2A shows another embodiment of the invention. Many of the key elements are similar to the embodiment shown in FIG. 2; thus, similar elements that perform similar functions are given the same reference numerals as in FIG. 2. Note that in FIG. 2, the braces are mounted and extend behind the backboard 37. In contrast, the embodiment depicted in FIG. 2A shows the bracket mounted to the mast and extending in front of the backboard 37. In this configuration, the brace assembly 14 is over the playing surface and thus may overhang the playing surface. In the embodiment shown in FIG. 2A, it is preferred that the second end 21 of the brace 20 be pivotally coupled to the mast 24 at a place much more proximate to the location 25 of the mast 24. This higher position keeps the braces 14 from interfering with play.

As seen in FIG. 3, a rod 42 may be placed on one of the braces 16, 20. In a preferred embodiment, the rod 42 is placed substantially co-axially with one of the holes 44 on the second end 17 of brace 16. In order to move the assembly 10' to the stowed position, the cable 27 drawn taut. The taut cable 27 and the rod 42 are cooperatively configured so that as the cable 27 is drawn taut, it moves the rod 42 and thereby urges the pair of braces 14 and connector 28 out of the aligned position, and "unlocks" the braces 14 and connector 28 from the aligned position. Then, the cable 27 is drawn taut in order to pivot the mast 24 toward the stowed position.

Figure 6:
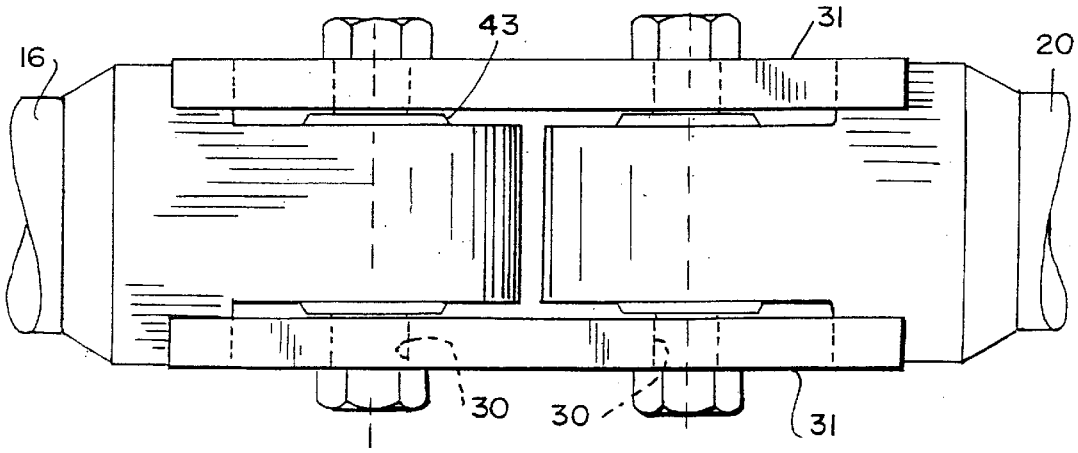
FIG. 6 is a plan view of the connector and braces of the current invention, shown in the play position.

FIG. 3 provides an exploded view of an embodiment of the linking arrangement. In this embodiment, connector 28 comprises a pair of spaced apart plates 31 with holes 30 that will align with holes 40 in webs 46 that extend from the second ends 18, 22 of the first 16 and second 20 braces. Each plate 31 and brace 16, 20 are configured to have a part of a stop 34, which includes a portion 59 on each plate 31, and also includes a cooperatively formed portion 55 on a raised area 48 of each brace 16, 20. The portion 55 includes a first portion 54 and second portion 52; similarly, the portion 59 on the connector 28 includes a first portion 62 and second portion 58 as well. As shown, the respective second portions arranged substantially perpendicularly to the first portions 62, 54. The second portion 58 of the plate 31 leads to a chamfered end 35. Similarly, the second portion 52 of each raised area 48 leads to an acutely angled portion 50. Each respective stop 34 is configured so that portions 55, 59 engage one another when in the play position, as shown in FIGS. 2, 4, and 6.

As seen in FIG. 3, the holes 30 in the connector 28 define pivot points that align with the pivot points for the connector 28. Each of the pivot points 17, 21, 30, 30 will be substantially aligned when the apparatus 10' is moved to the play position, which is shown in FIG. 2. As a result, compressive forces induced in the braces (resulting from a hard slam dunk, for example) will be aligned with the pivot points. As a result, there will be no induced moment about either pivot point 30 on connector 28.

Referring to FIG. 3, the webs 46 terminate in an edge 50 bordering a raised portion 48. As more clearly shown in FIGS. 4 and 5, the edge 50 is preferably angled, which allows the chamfered edges 35 of the connector 28 to freely pass in one rotational direction. In contrast, the stops 34 are configured so that the first portion 54 of the raised portion 48 engages the first portion 62 in order to limit further relative rotation in the opposite direction.

Figure 4:
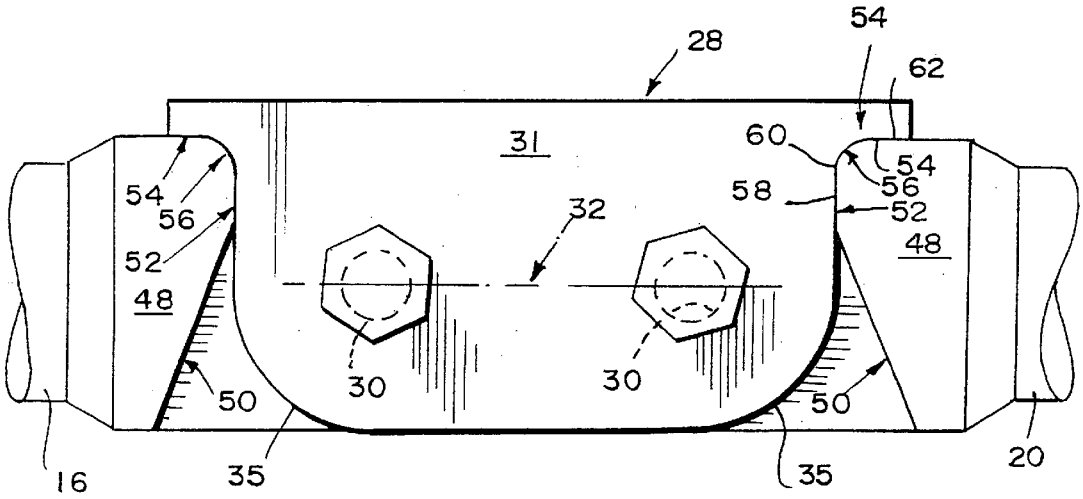
FIG. 4 is a front view of the connector and braces of the current invention, shown in the play position.

FIG. 4 shows a close-up of the connector 28 in the play position. As shown, the stop 34 is configured so that portion 55 on the raised area 48 engages cooperatively formed areas on the connector 28 in order to prevent further rotation past the play position. As shown in FIG. 5, however, the edges 50 of raised portion 48 are configured to allow clearance C for chamfered ends 35. In this way, the pair of braces 14 and the connector 28 are cooperatively configured to allow relative rotation until the braces 16, 18 are in the play position, but prevent rotation past this point of alignment.

Referring still to FIG. 4, the holes 30 define a pair of pivot points on the connector 28. The connector 28 has a pair of oppositely positioned stops 34, each stop positioned on the same side of longitudinal axis 32 of connector 28.

As shown in FIGS. 3 and 5, the stops 34 include a first section 62 that is generally parallel to the longitudinal axis 32; a curved portion 60 that bends, preferably through a 90 degree angle, into a straight portion 58.

Viewable in FIGS. 3 and 4, the raised portion 48 of the web 46 is cooperatively formed so that the straight portion 54 will engage the first portion 62 of the connector 28 when in the play position. The curved, intermediate portion 56 of the raised portion 48 is configured to engage the curved, intermediate portion 60 of the connector 28 in the play position. Additionally, the straight portions 52, 58 of the raised portion 48 and connector 28, respectively, engage one another in the play position as well. When these portions engage, they prevent further relative rotation past the play position.

Referring to FIGS. 3–5, on the opposite side of longitudinal axis 32 of connector 28, the connector has chamfered ends 35. The chamfered ends 35 allow rotational movement of braces 16, 20 in the direction of the chamfered ends 35; in contrast, the stops 34 limit rotation of the braces 16, 20 in the opposite direction. Therefore, the brace 14 is allowed to fully extend when the braces 16, 20 are aligned, as shown in FIGS. 3 and 4, and will lock when the fully aligned position is reached. The stop 34 prevents further rotation once the braces 14 reach the play position, which is shown in FIG. 2.

In order to assemble the embodiment shown in FIGS. 3–6, the plates 31 are aligned and spaced apart. The webs 46 are positioned between the plates 31 so that the holes 44 in the webs 46 align with the holes 30 in the plates 31. Once aligned, pins 38 are inserted through the holes, and nuts 40 connected thereto.

Note that second end 22 of second brace 20 also has a yoke 36 having holes 44. In order to properly link the braces 16, 20, the holes 44, 30 are respectively aligned, and pins 38 extend therethrough.

FIGS. 4 and 5 show a comparison between the configuration of the connector 28 when the assembly 10' is in the play position (as in FIG. 4) and the stowed, folded position (as in FIG. 5). Typically, the connector 28 and each of the braces will form a right-angle with one another. As shown in FIG. 5, however, when the assembly 10' is folded to a stowed position, the second ends 18, 22 will have some tolerance—hereinafter, play Pl—and are able to move with respect to one another and the connector 28. The edge 50 of the raised portion 48 is angled with respect to the longitudinal axis of the respective brace 16, 20. This angled arrangement allows not only for a clearance C, as shown in FIG. 5, but also allows the lower edge of the plate 31 to rotate past the right-angle disposition, thereby allowing for play Pl. The shown embodiment allows approximately 20 degrees of play Pl to either side of the right-angle position, for a total of approximately 40 degrees of play.

As seen in FIG. 5, the play Pl allows for tolerances in the installation that were not present in the prior art. As discussed above, the prior art system coupled the braces directly to one another rather than to a connector. Therefore, the prior art did not allow the degree of play—in the case of the present invention, about 40 degrees—that the current invention allows. Therefore, minute errors in installment of the prior art system could have resulted in a system which would not fold properly to a stowed position. The play Pl allowed by the current invention, however, gives a tolerance which is able to accommodate minor errors in positioning the braces.

As shown in FIGS. 3 and 6, a boss 43 surrounding a hole 44 is formed in webs 46 to align with holes 30 on connector 28. Additionally, the bosses 43 also provide space between surfaces of the plates 31 and the surface of the respective webs 46, which minimizes the amount of friction by reducing the surface-to-surface contact. The space created by the boss 43 may even provide a place to insert lubricant, such as oil or graphite.

Figure 7:
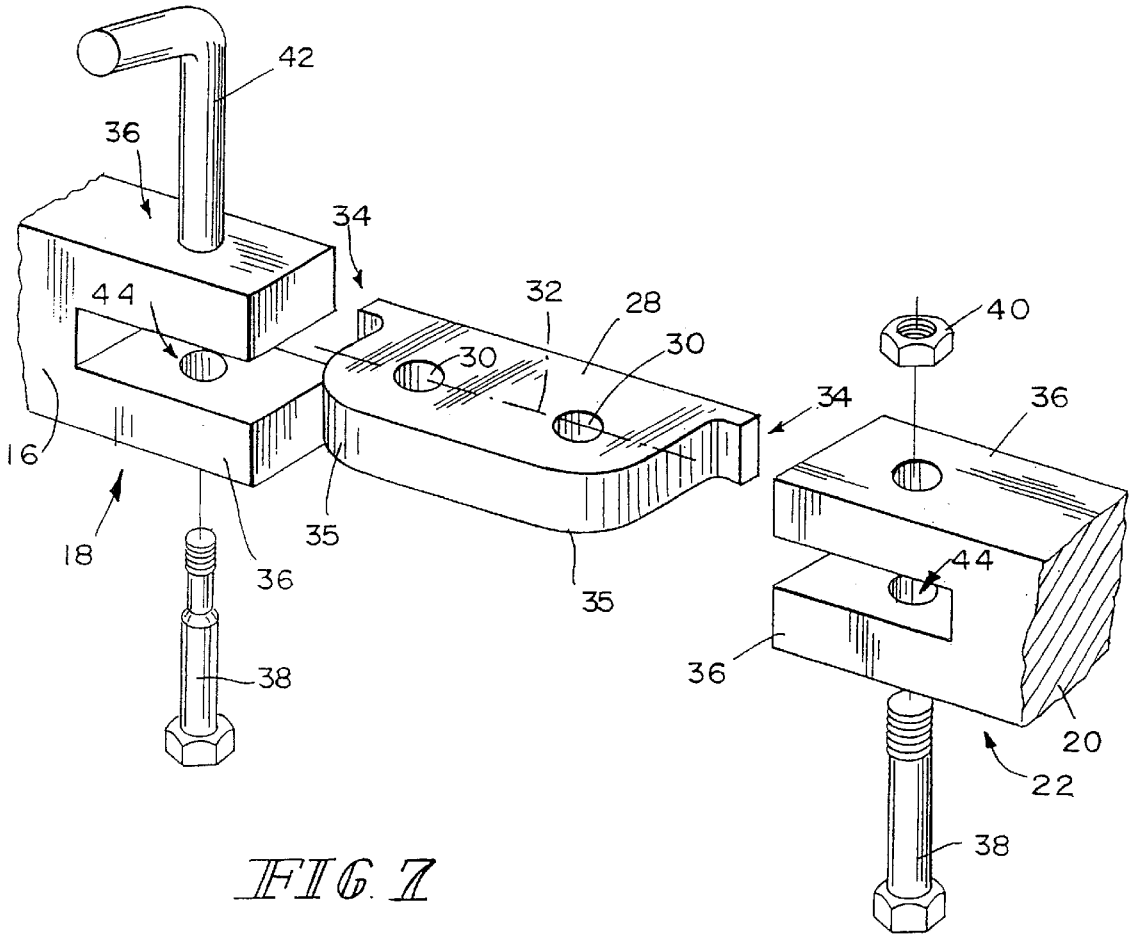
FIG. 7 is an exploded view of another embodiment of the connector, according to the principles of the current invention.

FIG. 7 shows an exploded view of another embodiment of the linking arrangement. Connector 28 typically has a pair of spaced apart holes 30. The second end 18 of first brace 16 has a yoke 36. The arms of the yoke 36 are spaced apart sufficient distance to accommodate connector 28. As with the embodiment previously shown, the embodiment in FIG. 7 also has a stop 34 configured to cooperate with a corresponding portion of yoke 36 to prevent further relative rotation of the braces 16, 18 past the play position.

Figure 8:
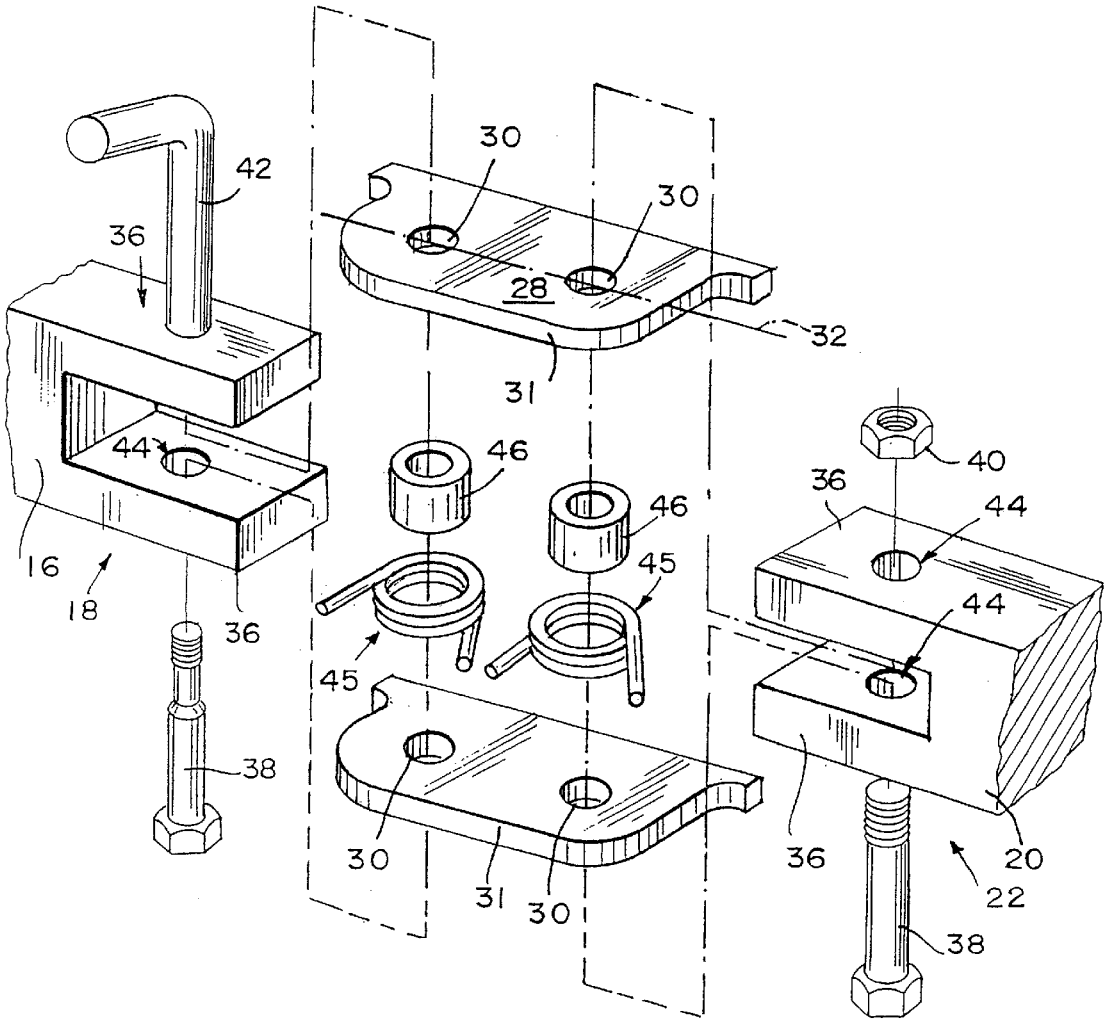
FIG. 8 is an exploded view of another embodiment of the connector, according to the principles of the current invention.

FIG. 8 shows an exploded view of another embodiment of the linking arrangement. The embodiment shown in FIG. 8 has many elements that are similar to the elements of previously mentioned embodiments. Elements having similar structure and function have been assigned identical reference numbers. As with the embodiment shown in FIG. 7, the second end 18 of the first brace 16 has a yoke 36. The arms of the yoke. 36 are spaced apart a sufficient distance to accommodate a connector 28. Each yoke 36 includes a hole 44, which will define a pivot point. In this embodiment, however, the connector 28 comprises a pair of spaced-apart plates 31, each having a pair of spaced-apart holes 30. In order to properly link the braces 16, 20, the holes 44, 30 are respectively aligned, and pins 38 extend therethrough. In order to bias the braces 16, 20 toward the play position, at least one torsion spring 45 is positioned between the plates 31. The torsion spring 45 also controls the pivoting of the braces 16, 20 to make the movement more smooth and even.

As shown in FIG. 8, the torsion spring 45 may be positioned around the pins 38 and extend into the second ends 18, 22 of the braces 16, 20. The assembly may also include a spacer 46 positioned between the plates 31 in order to maintain the plates 31 in a spaced-apart relation. The spacer 46 is shown as a cylinder through which the pins 38 extend and about which the torsion spring 45 is wrapped.

In order to assemble the assembly shown in FIG. 8, each pin 38 is inserted, at least part of the way, into a hole 44 in each respective yoke. Next, one of the plates 31 is positioned so that the pins 38 pass through the holes 30 in the plates 31. Then, the spacer 46 and the torsion spring 45 are positioned above the already-placed plate. Preferably, the torsion spring 45 may be placed concentrically around the pins 38. The torsion spring 45 should be configured to bias the assembly toward the play position. Although a single spring 45 is depicted in FIG. 8, it is possible to use a pair of torsion springs that bias the assembly.

After inserting the pin 38 into the first plate 31 and positioning the spring 45, the second plate 31 is then placed in a spaced apart relation to the other plate 31 so that the pins 38 pass through the respective holes 30 in each of the spaced apart plates 31. Then, the pin 38 passes through the hole 44 in the other arm of the yoke 36. A nut 40 may be affixed after the pin 38 passes through the holes 30,44. Also as seen in FIG. 8, a spacer 46 may be placed between the plates 31.

In any embodiment of the invention, the braces 16, 20 are typically tubular, and the webs 46 or yokes 36 are welded to the second ends 18, 22 thereof Because the braces can be made from standard tubular stock, they can be specially made to fit any size gymnasium, and the braces 14 can be assembled with a simple weld.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. An overhead sport assembly movable between a play position to a stowed position, the assembly comprising:

a mast having a longitudinal axis pivotally coupled to an overhead structure near a first end of the mast;

a pair of braces holding the mast in the play position, the pair of braces including a first brace with a first end pivotally coupled to an overhead structure at a pivot point displaced from the first end of the mast, and a second brace with a first end pivotally connected to the mast at a pivot point displaced from the first end of the mast;

a connector linking the second ends of the braces; and, the second ends of the braces are pivotally coupled to the connector body at respective pivot points displaced from one another along the connector.

2. The assembly of claim 1, further comprising a stop formed so that, when in the play position, the first brace is allowed to rotate with respect to the connector body only in a first direction of rotation, and the second brace is allowed to rotate with respect to the connector body opposite the first direction.

3. The assembly of claim 2, wherein the stop includes:

a first portion on the connector extending from the connector parallel to its longitudinal axis, a second portion on the connector substantially perpendicular its longitudinal axis; and, a raised area on the second end of each brace, each raised area having a first portion substantially parallel to a longitudinal axis of the respective brace, and a second portion substantially perpendicular to the longitudinal axis of the connector; wherein, the respective first and second portions engage one another when in the play position.

4. The assembly of claim 3, wherein the connector further includes an intermediate portion connecting the first and section portions of the connector; and, the raised area further includes an intermediate portion connecting the first and second portions of the raised area; and wherein the respective intermediate portions of the raised area and connector engage one another when in the play position.

5. The assembly of claim 3, wherein the raised area further comprises an angled portion extending from the second portion of the raised area and disposed at an acute angle with respect to the longitudinal axis of the brace in a direction away from the connector, the angled portion configured to provide a clearance allowing the connector to rotate toward the stowed position.

6. The assembly as in claim 5, wherein the connector comprises chamfered ends configured to allow clearance between the angled portion and the chamfered ends as the assembly is moved toward the stowed position.

7. The assembly of claim 1, further comprising a pair of yokes extending from respective opposite ends of the connector, each of the yokes having holes; and, further including holes in the second ends of the braces; and wherein a pin extends through each of the respective holes in the yokes, each pin thereby defining a pivot point.

8. The assembly of claim 1, further comprising an off-center coupling arrangement coupling the mast to the overhead structure at a location displaced from the longitudinal axis of the mast, thereby creating a rotating moment configured to create tensile force in the braces when the assembly is in the play position.

9. The assembly of claim 1, wherein the pivot points are substantially aligned when in the play position.

10. The assembly of claim 1, wherein the connector includes a pair of spaced-apart plates, each plate having a pair of spaced-apart holes;

the second ends of each of the first and second braces terminating in a web having a hole, wherein each brace is pivotally coupled to the connector by a pin respective extending through a respective hole to define respective pivot points.

11. The assembly of claim 10, further comprising at least one torsion spring positioned between the spaced apart plates and configured to bias the braces into the play position.

12. The assembly of claim 10, further comprising a spacer positioned between the plates.

13. The assembly as in claim 1, further comprising at least one torsion spring connected to and biasing the connector and at least one brace toward the play position.

14. The assembly as in claim 1, further comprising a backboard mounted adjacent a second end of the mast, and the braces extend behind the backboard.

15. The assembly as in claim 1, further comprising a backboard mounted adjacent a second end of the mast, and the braces extend in front of the backboard.

16. The assembly of claim 1, further comprising a cable and pulley arrangement configured to allow an operator to selectively move the mast between the stowed and play positions.

17. The assembly of claim 16, further comprising a rod extending from one of the first brace, second brace, or connector; wherein, as the cable is pulled in order to pivot the mast toward the stowed position, the cable moves the rod and causes the braces to break from the play position toward the stowed position.

18. The assembly of claim 1, further comprising a yoke with a pair of aligned holes, the yoke extending from respective second ends of each of the first and second braces; and, the connector includes holes; and a pin extends through each of the respectively aligned holes in the connector and yokes, each pin thereby defining a pivot point.

19. An overhead sport assembly movable between a play position and a stowed position, the assembly comprising:

at least one mast pivotally coupled to an overhead structure near a first end of the mast;

a pair of linked braces positioned to hold the mast in the play position, the pair of braces having a first end pivotally connected to the mast at a location displaced from the first end of the mast, and a second end pivotally coupled at a location distal from the mast;

a connector linking the braces by pivotally coupling to the braces at locations displaced from one another along a longitudinal axis of the connector;

wherein, as the overhead sport assembly moves from the stowed position to the play position, the braces move from a folded position to the play position.

20. The assembly as in claim 19, wherein the connector further includes a stopping means which allows relative rotation between the pair of braces while the braces move from the stowed position to the play position, but limits relative rotation past the play position.

21. The assembly of claim 20, wherein the connector further includes an intermediate portion connecting the first and section portions of the connector; and, the raised area farther includes an intermediate portion connecting the first and second portions of the raised area; and wherein the respective intermediate portions of the raised area and connector engage one another when in the play position.

22. The assembly of claim 20, wherein the raised area further comprises an angled portion extending from the second section and disposed at an acute angle with respect to the longitudinal axis of the brace in a direction away from the connector, the angled portion configured to provide a clearance allowing the connector to rotate toward the stowed position.

23. The assembly as in claim 22, wherein the connector comprises chamfered ends configured to allow clearance between the angled portion and the chamfered ends as the assembly is moved toward the stowed position.

24. The assembly as in claim 22, further including an intermediate portion connecting the first and second portions of the raised area; wherein, the respective intermediate portions of the raised area and the connector engage one another when in the play position.

25. The assembly as in claim 19, wherein the pivot points substantially align in the play position.

26. The assembly as in claim 19, wherein the means for moving the overhead assembly comprises a cable and pulley arrangement configured to allow an operator to selectively move the mast between the play and stowed positions.

27. The assembly as in claim 19, further comprising a rod extending from the pair of linked braces, cable and rod cooperatively configured so that the cable engages the rod and urges the braces to break from the play position.

28. An overhead sport assembly, comprising;

a mast pivotally coupled to an overhead structure;

a means for pivoting the mast between a stowed position and a play position;

a means for holding the mast in the play position, the holding means including a pair of braces, the first brace pivotally coupled to the overhead structure at a first pivot point and the second brace pivotally connected to the mast at a second pivot point, and a connecting means linking the braces at respective pivot points displaced from one another; and, a stopping means for preventing the braces from unfolding from the stowed position past the play position.

29. The overhead sport assembly of claim 28, further comprising a means for breaking the braces from the play position and urging the beams toward the stowed position.

30. The overhead sport assembly of claim 28, wherein the connecting means includes a pair of spaced-apart plates having holes, and the braces have webs with holes, the webs extending from ends of the braces; wherein, the braces are pivotally coupled by inserting a pin through the respective aligned holes in the webs and plates in order to define pivot points.

31. The overhead sport assembly of claim 30, further comprising at least one torsion spring positioned between the spaced-apart plates and configured to bias the braces into the play position.

32. The assembly of claim 30, further comprising a spacer positioned between the plates.

33. The overhead sport assembly of claim 30, wherein the pivot points are substantially collinear when the mast is in the play position.

34. The overhead sport assembly of claim 28, wherein the connecting means includes a connector configured to receive respective ends of the first and second braces at spaced-apart pivot points.

35. The overhead sport assembly of claim 28, further comprising an off-center coupling arrangement configured to pivot the mast about a point displaced from its central longitudinal axis, thereby inducing a moment which creates a tensile force in the braces.

36. An overhead sport assembly as in claim 28, wherein the pivot points substantially align in the play position.

37. An overhead sport assembly movable between a play position and a stowed position, the assembly comprising:

a mast pivotally coupled to an overhead structure near a first end of the mast;

a pair of braces for supporting and holding the mast in the play position, the pair of braces including a first brace with a first end pivotally coupled to an overhead structure at a pivot point displaced from the first end of the mast, and a second brace with a first end pivotally connected to the mast at a pivot point displaced from the first end of the mast;

the second ends of the braces being pivotally coupled to a connector at respective pivot points displaced from one another along the connector;

the braces and the connector being cooperatively configured to allow the braces to pivot from the stowed position to the play position, and further configured to prevent further rotation past the play position;

wherein the pivot points are substantially aligned when in the play position.

* * * * *